United States Patent [19]

Miller

[11] Patent Number: 4,638,132

[45] Date of Patent: Jan. 20, 1987

[54] ELECTRICAL PRESSURE SWITCH

[75] Inventor: Ellsworth S. Miller, Mt. Clemens, Mich.

[73] Assignee: Lectron Products, Inc., Rochester, Mich.

[21] Appl. No.: 791,712

[22] Filed: Oct. 28, 1985

[51] Int. Cl.[4] ..... H01H 35/38

[52] U.S. Cl. ..... 200/81 R; 200/82 R; 200/83 J; 200/277; 200/302.1; 73/745

[58] Field of Search ..... 200/81 R, 82 R, 82 B, 200/82 D, 83 N, 83 Q, 83 J, 275, 277, 290, 302.1, 302.2, 306; 307/118; 137/539; 73/745; 340/626

[56] References Cited

U.S. PATENT DOCUMENTS 3,733,449 5/1973 Parker ..... 200/83 Q
3,739,119 6/1973 Rike ..... 200/82 R
3,939,316 2/1976 Stopkay ..... 200/82 D
4,007,343 2/1977 Alten ..... 200/81 R

*Primary Examiner*—G. P. Tolin
*Attorney, Agent, or Firm*—Harness, Dickey & Pierce

[57] ABSTRACT

A pressure switch having a ball valve or contact mounted in an internal chamber to move in response to predetermined relatively high and relatively low fluid pressures in an inlet that opens into the chamber to make or break an electrical circuit through the switch and that incorporates a one-piece sealing element that is constantly exposed to the fluid pressure and is uniquely formed and cooperative with the ball contact and with the walls of the chamber to prevent leakage of the fluid from the chamber effectively without significantly interfering with free unobstructive movement of the ball contact in use.

13 Claims, 3 Drawing Figures

ELECTRICAL PRESSURE SWITCH

BACKGROUND OF THE INVENTION

Pressure switches conventionally respond to a predetermined fluid pressure or a variation in the pressure to open or close a circuit between fixed spaced electrical contacts or terminals. In these conventional switches, a movable contact usually carried by a flexible diaphragm moves between open and closed positions in response to the fluid pressure to make or break the circuit.

SUMMARY OF THE INVENTION

The present invention provides a modified switch construction that eliminates the diaphragm and the attendant operational problems caused by the diaphragm mounting for the movable contact. More particularly, the present invention utilizes a ball valve as the movable contact and provides a unique combination and association of the ball with a seal that itself is uniquely formed and is related to adjacent parts of the switch in a novel manner that permits the switch to be readily adapted for either normally open or normally closed operation. The seal is mounted in the switch in such a way that it is constantly exposed to the fluid pressure to which the switch responds and the pressure against the seal helps hold the latter in fluid-tight engagement with the ball contact as well as with related stationary parts of the switch structure. At the same time, the seal causes little if any significant resistance to or interference with free unrestricted movement of the ball contact. Thus, the novel association and relationship of parts is more efficient in use than the diaphragm mounting previously used, as well as other forms of pressure switches known to applicant. Moreover, there is less chance of pressure leaks in the switch, and it is significantly less expensive to manufacture.

DESCRIPTION OF THE PREFERRED EMBODIMENTS

Figure 3:
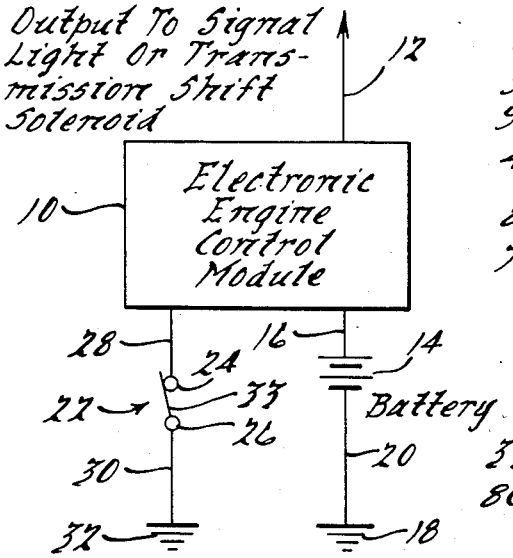
FIG. 3 is a diagrammatic view showing the pressure switch of this invention in a typical environment.

Although the pressure switch of this invention has general utility, it is primarily adapted and pre-eminently suited for use in a manner well known in the art, in automatic transmissions for automotive vehicles. As illustrated diagrammatically in FIG. 3, transmission systems typically include an electronic engine control module 10 having an output 12 which is electrically connected to a signal light (not shown) or to the transmission shift solenoid (also not shown). Power for the electronic engine control module 10 is supplied by a battery 14 which is connected at one side to the control module 10, as indicated at 16, and at the other side thereof to ground 18, as indicated at 20. A pressure switch 22, such as the one embodying the present invention, for example, has spaced terminals 24 and 26 that are electrically insulated from each other and connected as at 28 and 30 to the control module 10 and to ground 32. A movable contact designated generally at 33 is movable between open and closed positions in response to predetermined pressures or variations thereof to which the switch is subjected and to which it responds to interconnect the terminals 24 and 26 so as to permit current to flow through the switch from the control module 10 to ground at 32 or to electrically isolate the terminals from each other as will be well understood by those skilled in the art. In FIG. 3, the pressure switch 22 is shown in a closed position.

Figure 1:
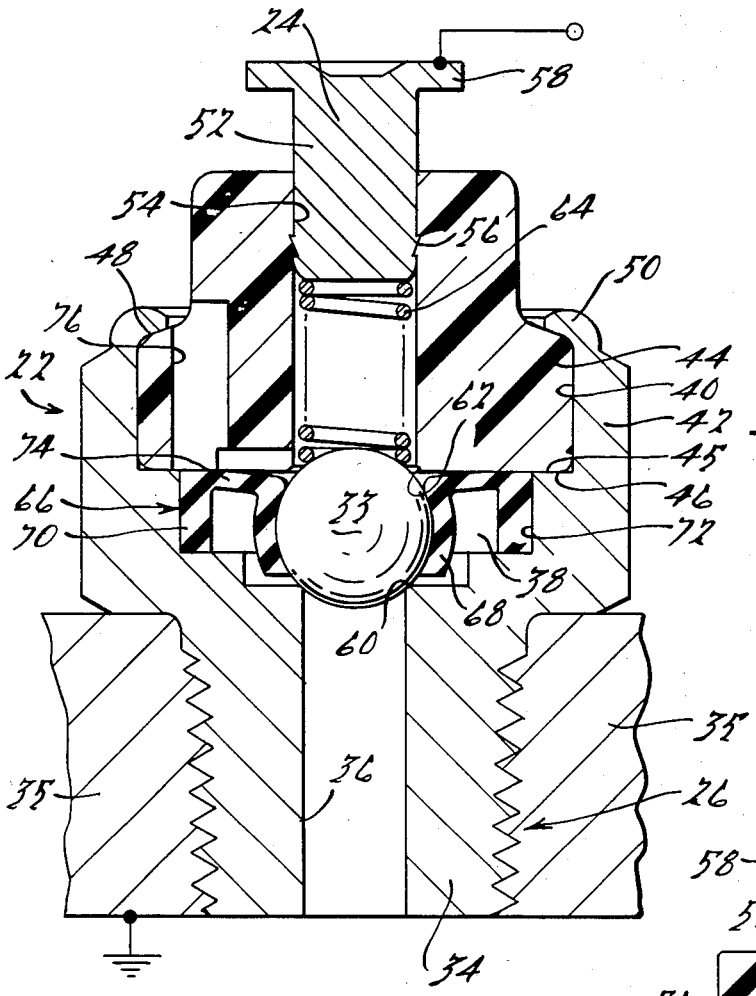
FIG. 1 is a longitudinal sectional view of a normally closed pressure switch embodying the instant invention showing the switch in the closed position.

For a detailed description of a normally closed pressure switch embodying this invention, reference is first had to FIG. 1 that graphically shows the two fixed upper and lower electrical terminals 24 and 26 of brass or other suitable electrically conductive material. In the particular use with an automotive transmission system referred to above, the switch 22 is mounted inside the transmission; and the bottom terminal 26, as the switch is shown in the drawing, has a depending, externally threaded coupling portion or shank 34 that is adapted to be screwed into an electrically grounded aluminum housing 35 inside the transmission where a port or inlet 36 opening through the end of the coupling is in communication with fluid under pressure in the housing. This fluid enters a central chamber 38 in the switch through the port 36.

As shown in the drawing, the upper end or top of the chamber 38 opens into a larger diameter chamber 40 which is defined by an upstanding annular peripheral wall 42 that surrounds and snugly fits a cover 44 of a suitable electrically insulative, compressive and resilient material such as nylon or the like. As shown in the drawing, the bottom 46 of the cover 44 seats on a radial shoulder 45 formed at the juncture of the chambers 38 and 40 so that the cover in effect provides a top closure for the lower or central chamber 38. Thus, the chamber 38 is in communication through the port 36 with fluid pressure in the transmission housing 35.

The cover 44 projects above the peripheral wall 42 of the lower terminal 26; and the upper marginal edge portion 50 of the surrounding wall 42 is spun over or staked against an upwardly tapered annular shoulder 48 formed externally on the cover 44. The staking operation presses the staked marginal edge portion 50 against the shoulder 48 with sufficient force so that it presses the cover 44 axially downwardly against the shoulder 45 and radially outwardly against the wall 42 to create and maintain an effective seal therebetween.

The shank portion 52 of the upper terminal 24 is press fitted into the upper end portion of a through opening 54 provided centrally in the cover 44 and a plurality (here shown as two) of annular barbs 56 formed on the terminal embed themselves in the yeildable material from which the cover is made to hold the terminal securely in the opening at all times. The upper terminal 24 is a conventional rivet-type having the shank portion 52 thereof extending into the opening 54; and the flanged upper end portion 58 disposed substantly above the cover 44 for ready attachment to the usual coupling of a wire or cable forming part of the conventional automotive transmission system. In this connection, it will be observed that the radial flange 58 at the top of the terminal 24 is adapted to slidably join and to interconnect with a conventional channel-shaped electrical conductor which is not shown graphically but is shown diagrammatically at 30 in FIG. 3. As indicated previously, when the pressure switch is adapted and intended for use with an automotive transmission, the conductor 30 extends from the terminal 24 and is connected to the electronic engine control module 10.

At its lower end, the opening 54 opens into the chamber 40. The movable contact 33, which is in the shape of a ball or sphere, as shown in the drawings, is disposed in the chamber 38 and is movable between and independently engageable with opposed, axially spaced, lower and upper seats 60 and 62 at the top of the port 36 and the bottom of the opening 54, respectively. A helical spring 64 confined between the upper terminal 24 and the movable contact 33 holds the latter normally in engagement with the lower seat 60. A double lipped annular seal 66 of a suitable flexible and resilient material such as fluorosilicone, nylon, or the like also in the chamber 38 surrounds the ball contact or valve 33. As shown in the drawing, the radially spaced, axially downwardly extending annular inner and outer lip portions 68 and 70 of the seal 66 fit snugly against the ball valve 33 and the annular wall 72 of the chamber 38. The top bight portion 74 of the seal 66 seats upwardly against the bottom of the cover 44.

The helical spring 64 is sufficiently strong to hold the ball valve 33 in pressed engagement with the lower seat 60 when a relatively low fluid pressure obtains in the inlet 36. This is the normal condition in an automotive transmission system so that the pressure switch shown in FIG. 1 is normally closed since current can flow between the terminals 24 and 26 through the metal spring 64 and ball valve 33. However, when a relatively high pressure sufficient to overcome the resistance of the spring 64 obtains in the inlet 36 and against the ball valve 33, the latter lifts off the seat 60 and moves upwardly against the seat 62. This action opens the switch since current can no longer flow between the ball valve 33 and the lower terminal 26 and the two terminals 24 and 26 are electrically insulated from each other by the cover 44. Manifestly, when the switch is open in the position last described, fluid under relatively high pressure in the inlet 36 flows into the chamber 38 and exerts pressure against the inner lip and bight surfaces of the seal 66 to effectively prevent leakage of the fluid between the inner lip 68 and the ball valve 33 and also between the outer lip 70 and the surrounding annular wall 72 of the chamber 38. In practice, the seal 66 has proved to be exceedingly effective in preventing any leakage at all from the switch under conventional conditions of temperature and pressure existing in automotive transmission systems and similar environmental situations. Further with regard to the transmission system environment, it will be appreciated that the interior of the transmission above the housing 35 is at or substantially at atmospheric pressure; and the opening 54 communicates therewith through an axially extending side relief port or vent 76 in the cover 44 that opens exteriorly of the latter at the upper end thereof just inwardly of the rolled lip 50. At its lower end the vent 76 communicates with the opening 54 through a radial groove in the bottom 46 of the cover. Thus, the pressure differential across the ball valve or contact 33 is always equal to the pressure differential between the transmission pressure and atmospheric pressure. From the foregoing, it will be readily apparent that, in use, the pressure switch hereinabove described functions as a normally closed switch and that it responds to variations in pressure in the port 36 to move between the normally closed position shown in FIG. 1 and the open position described above. When the fluid pressure in the port 36 is equal to or less than a predetermined minimum pressure, it exerts insufficient pressure against the movable ball valve 33 to overcome the resistance of the spring 64. However, when the fluid pressure in the port 36 exceeds a predetermined maximum pressure that is sufficient to overcome the resistance of the spring 64, the ball contact 33 lifts off the seat 60 and moves into engagement with the upper seat 62. In practice, the predetermined minimum pressure may be any pressure between atmospheric pressure or less and a pressure that is only a few degrees less than the predetermined maximum pressure. Thus, as long as the fluid pressure in the port 36 is significantly less than the predetermined maximum pressure, the two terminals 24 and 26 are electrically interconnected through the spring 64 and the ball contact 33 to complete an electrical circuit through the switch. On the other hand, whenever the fluid pressure in the port 36 is significantly greater than the predetermined maximum pressure, the fluid pressure will lift the movable ball contact 33 off of the lower seat 60 and into engagement with the upper seat 62 to break the electrical connection between the two terminals 24 and 26 since, in the open position of the contact 33 last described, the two fixed contacts 24 and 26 are electrically insulated from each other by the cover 44.

Manifestly, the value of the predetermined pressure required to open the switch can be regulated by varying the strength of the spring 64. As a practical matter, this value of course can be easily regulated and controlled. In a typical transmission environment, for example, the pressure switch of this invention normally will remain in the closed position shown in FIG. 1 so long as a fluid pressure less than about 33 psi obtains in the port 36 and it will move to and remain in the open position when there is a fluid pressure of 35 psi or more in the port 36. Thus, the contact 33 performs a dual function of serving as a movable electrical contact and also as a ball valve to maintain an effective pressure seal in all operating conditions of the switch.

As a result of the unique construction and arrangement of parts of the pressure switch of this invention, it is not necessary for the movable contact or ball valve 33 to engage the lower seat 60 sufficiently closely to seal the port 36, since that function is served by the seal 66. Since all parts of the seal 66 are backed-up in one way or another, it can be made exceedingly thin and as a result it offers very little, if any, resistance to movement of the ball contact 33. As a result, the contact 33 is exceedingly sensitive to changes in fluid pressure in the inlet 36 and the switch will remain closed until the fluid pressure in the port 36 is almost at opening pressure. Then the ball contact 33 moves quickly off of the seat 60 to open the switch. Moreover, it will repeat the switch opening movement at precisely the same pressure constantly. Furthermore, it is not necessary to increase the assembly time required in the manufacture of the switch or to incur the additional cost of providing a finely finished or special seat of plastic material or the like in order to assure an effective seal for the fluid pressure in the transmission. The latter function is served effectively by the seal 66 that can be assembled easily and quickly and can be obtained relatively inexpensively in a wide range of sizes. All of these considerations, plus the fact that the pressure switch of this invention requires fewer parts than conventional pressure switches now in use in order to perform the necessary functions in use renders the entire assembly of parts significantly less expensive.

Figure 2:
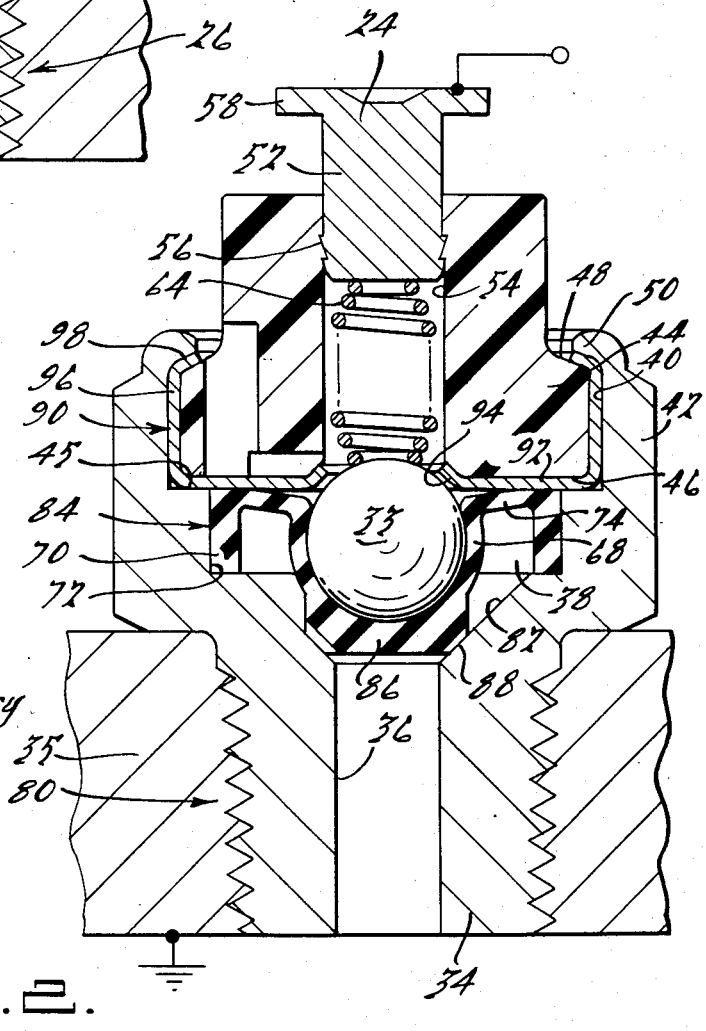
FIG. 2 is a longitudinal sectional view similar to FIG. 1 but showing the switch modified for normally open operation and illustrating the switch in the open position.

Reference is next had to FIG. 2 which shows a normally open electrical pressure switch embodying the present invention. This normally open switch is generally similar to the normally closed switch first described and it involves only minor changes in construction in order to adapt it for a normally open mode of use. Accordingly, those parts that are common to the two switches are identified by corresponding reference numbers; and only the parts that distinguish the two switches are numbered differently.

In connection with the foregoing, it will be readily apparent that the upper terminal 24, the ball valve or contact 33, the cover 44, and the spring 64 shown in FIG. 2 are identical in all essential respects to the corresponding elements described in connection with the first form of the invention. The only differences are in the lower terminal and in the seal. Further in this connection, it will be observed that the lower terminal 80 of the normally open switch is identical to the lower terminal of the normally closed switch except that the former is provided with a downwardly tapered surface 82 at the juncture of the inlet port 36 and the central chamber 38 instead of the stepped surface employed in the normally closed switch. Similarly, in the normally open switch of FIG. 2, the seal 84 is identical to the seal 66 used in the normally closed switch except that inner lip 86 is closed at the bottom thereof by an integral wall 86. The above difference notwithstanding, however, the seal 84 is still a one-piece element that can be manufactured inexpensively and is easy to install at assembly. In practice, the bottom wall 86 only is made relatively thicker than the rest of the seal which remains essentially thin and flexible. The thin, flexible seal members are backed-up as in the normally closed switch first described and this feature provides the same advantages attributable thereto in the normally closed version of the switch. The increased thickness of the bottom wall 84 gives it additional rigidity, and it is formed with a downwardly tapered surface 88 that complements and seats on the surface 82. Also, the tapered surface 88 is provided with one or more downwardly opening radial grooves to assure constant communication between the inlet port 36 and the chamber 38 between the inner and outer lips 68 and 70.

In use, the spring 64 acts through the ball valve 33 to hold the beveled surface 88 of the seal 84 firmly engaged with its seat 82 so long as the pressure in the inlet 36 and chamber 38 is at or below the predetermined minimum range described above. However, when the fluid pressure increases to the predetermined maximum pressure or above, fluid pressure acting against the bottom of the seal 84 flexes the latter upwardly and lifts the ball valve 33 against the counteracting pressure of the spring 64.

In the normally open form of the pressure switch of this invention, a generally cup-shaped contact 90 of an electrically conductive material such as brass or the like is interposed between the lower terminal 26 and the cover 44. As shown in the drawing, the contact 90 has an annular radial portion 92, the outer marginal portion of which rests on and is supported by the shoulder 45 and the inner marginal portion of which is beveled upwardly to form an annular seat 94 that surrounds the upper portion of the ball valve 33 but is normally spaced from the ball 33. At its outer periphery, the radial portion 92 of the contact 90 is integrally joined to an axially extending, upstanding annular portion 96 that fits between and is confined by the terminal wall 42 and the lower portion of the cover 44. At its upper edge the annular wall portion 96 is spun angularly inwardly at substantially the same angle as the shoulder 48, as shown at 98, and it is pressed solidly against the shoulder by the spun-over marginal edge portion 50 of the lower terminal 80. The contact 90 has a good electrical contact with the lower terminal 80 so that, when the ball valve 33 is in the raised position against the seat 94, it also makes good electrical contact with the lower terminal 26 through the contact 90. When the marginal edge portion 50 is spun inwardly and downwardly against the marginal edge portion 98 of the contact 90 it presses the latter firmly against the tapered shoulder 48 and exerts pressure axially against the cover 44 tending to hold the contact 90 firmly against the shoulder 45 to further assure a good electrical contact therebetween.

From the foregoing, it will be apparent that, when the fluid pressure in the lower terminal port 36 is at or below a predetermined pressure, the action of the helical spring 64 will overcome the fluid pressure and hold the movable contact 33 in the "down" position exactly as in the form of the invention first described. However, since in the normally open switch of FIG. 2, the movable contact 33 is electrically insulated from the terminal 80 by the seal 84 and is out of engagement with the metal contact 90, the electrical circuit between the upper and lower terminals 24 and 80 is broken and the switch is in the "open" position. On the other hand, if the fluid pressure in the lower terminal port 36 is at or above a predetermined higher pressure, it overcomes the resistance of the helical spring 64 and moves the ball valve 33 upwardly against the metal contact 90. As soon as this happens, an electrical circuit is established between the two terminals 24 and 80. It will also be apparent that the closed circuit between the two terminals 24 and 80 will be maintained so long as the fluid pressure in the port 36 remains above the predetermined maximum pressure. However, as soon as the fluid pressure in the port 36 drops significantly below the predetermined minimum pressure referred to, the action of the helical spring 64 overcomes the counteraction of the fluid pressure and moves the ball valve 33 downwardly out of engagement with the contact 90 and to open the circuit between the two terminals 24 and 80.

Manifestly, the normally open switch (FIG. 2) has all of the advantages of the normally closed switch first described. Also, the normally open switch shown in FIG. 2 comprises a relatively small number of parts; and the parts are either items that are readily available "off-the-shelf" or they can be manufactured relatively inexpensively. Similarly, the particular pressure at which the fluid in the port 36 overcomes the action of the helical spring 64 can be readily controlled and adjusted by varying the size and strength of the spring so that the pressure switch can be readily adapted to the requirements of any particular environmental situation where it is intended and adapted for use.

I claim:

1. An electrical pressure switch comprising a housing provided with an internal chamber having an annular peripheral wall and an inlet communicating with said chamber and adapted to be connected to and to communicated with a source of relatively high and relatively low fluid pressures;

first and second electrical terminals electrically insulated from each other and disposed coaxially with respect to said peripheral wall;

a valve seat in said chamber disposed coaxially with respect to said wall and to said terminals;

a ball valve in said chamber movable within predetermined limits to and from said valve seat;

a compression spring confined between one of said terminals and said ball valve holding the latter at one limit of its travel with respect to said valve seat; and a one-piece sealing element in said chamber having radially spaced inner and outer sealing lips extending axially in the direction of said inlet and of the other of said terminals, said ball valve being movable with respect to said valve seat to one limit of its travel against the resilient action of said spring means by fluid pressure in said chamber, and the sealing lips of said sealing element being urged in opposite directions by said fluid pressure into sealing engagement with said ball valve and said annular wall.

2. An electrical pressure switch comprising a housing provided with an internal chamber having a peripheral wall and an inlet to said chamber adapted to be connected to and to communicate with a source of relatively high and relatively low fluid pressures;

a pair of electrical terminals on said housing;

means electrically insulating said terminals from each other;

means of electrically conductive material defining an annular seat disposed in said chamber in coaxial relation with respect to said inlet;

means normally electrically connecting one of said terminals to said seat;

a ball valve in said chamber movable to and from said seat;

compression spring means interposed between and in engagement with the other of said terminals and said ball valve normally urging the latter axially relative to said seat; and a one-piece seal having radially spaced inner and outer sealing lip portions extending axially in the direction of said inlet and disposed concentrically with respect to said inlet with the space between said lip portions in communication with said inlet, said inner lip portion being in overlapping relation and in sealing engagement with said ball valve, and said outer lip portion being in overlaying relation and in sealing engagement with the peripheral wall of said chamber.

3. An electrical pressure switch as in claim 2 wherein the inner lip portion of said seal is joined to and fully closed in by an integral transverse wall member; and wherein said wall member overlays and seals a side of said ball valve remote from said compression spring means and faces in the direction of said inlet.

4. An electrical pressure switch as in claim 2 wherein said annular seat is coincident with said inlet where the latter opens into said chamber.

5. An electrical pressure switch as in claim 2 wherein said inlet opens into said chamber opposite said other terminal and said compression spring; and wherein said seat is a formed part of said chamber where said inlet opens into said chamber.

6. An electrical pressure switch as in claim 2 including means defining an air outlet behind said seal and extending from said chamber to atmosphere.

7. An electrical pressure switch as in claim 2 wherein said inlet and said seat are disposed in coincident relation with respect to each other and directly in front of said ball valve; and wherein said other terminal and said compression spring means are disposed behind said ball valve and in coincident relation with respect to each other and to said inlet and said annular seat.

8. An electrical pressure switch as in claim 7 including means defining an outlet disposed behind said seal and extending from said chamber to atmosphere.

9. An electrical pressure switch as in claim 3 including bypass means in said housing providing communication between said inlet and said chamber between the inner and outer sealing lip portions of said seal whereby fluid under pressure in said inlet has access through said bypass means to said chamber to exert pressure against said inner and outer sealing lip portions to hold the latter in sealing engagement with said ball valve and the peripheral wall of said chamber, respectively.

10. An electrical pressure switch as in claim 2 or 3 wherein said seat is disposed behind said seal and at the same side of said ball valve as said compression spring means, said ball valve being spaced away from said seat by said compression spring means when a relatively low fluid pressure obtains in said inlet and movable into engagement with said seat against the resilient action of said compression spring means by a relatively high fluid pressure in said inlet.

11. An electrical pressure switch as in claim 2 wherein said terminals are electrically insulated from each other by a cover member of flexible and resilient electrically insulating material having a through opening disposed centrally therein, wherein said other terminal and said compression spring means are disposed in the central opening of said cover; and including an electrical contact having a radial portion in said chamber behind said seal, said radial portion carrying and being electrically connected to said seat and also being in engagement with said one terminal and providing an electrical circuit between said seat and said one terminal.

12. An electrical pressure switch as in claim 11 wherein said contact further has a longitudinally extending annular portion confined between said cover and said one terminal.

13. An electrical pressure switch as in claim 12 wherein said cover is formed with a tapered annular shoulder and the longitudinally extending portion of said contact is formed with a correspondingly tapered annular portion overlapping said tapered shoulder, and wherein a portion of said one terminal overlays and presses against the tapered annular portion of said contact and transmits a force longitudinally of said cover through the tapered portion of said contact against the tapered shoulder of said cover holding said contact in pressed engagement with said one terminal.

* * * * *